United States Patent [19]

Porter

[11] Patent Number: 4,786,265

[45] **Date of Patent: * Nov. 22, 1988**

[54] MARINE ENGINE EXHAUST MUFFLER

[75] Inventor: Victor B. Porter, Decatur, Ind.

[73] Assignee: Thunderbird Products Corporation, Decatur, Ind.

[ * ] Notice: The portion of the term of this patent subsequent to May 17, 2005 has been disclaimed.

[21] Appl. No.: 46,298

[22] Filed: May 4, 1987

Related U.S. Application Data

[63] Continuation-in-part of Ser. No. 887,343, Jul. 21, 1986, Pat. No. 4,744,778.

[51] Int. Cl.[4] ..... B63H 21/32

[52] U.S. Cl. ..... 440/89; 114/343; 181/235

[58] Field of Search ..... 440/89, 900; 181/235; 114/343

[56] References Cited

U.S. PATENT DOCUMENTS

| | | | |
|---|---|---|---|
| 830,908 | 9/1906 | Martin | 440/51 |
| 1,065,707 | 6/1913 | Montgomery | 440/89 |
| 3,452,704 | 7/1969 | Watkins | 440/89 |
| 3,599,595 | 8/1971 | James | 440/89 |
| 3,742,895 | 7/1973 | Horiuchi | 440/89 |
| 4,002,136 | 1/1977 | Michalak | 440/89 |
| 4,167,987 | 9/1979 | Turner | 181/235 |
| 4,586,908 | 5/1986 | Schlichthorst | 440/89 |

FOREIGN PATENT DOCUMENTS

| | | | |
|---|---|---|---|
| 622414 | 5/1949 | United Kingdom | 440/89 |

OTHER PUBLICATIONS

Conroy X19 Brochure rec at PTO Jan 18, 1985.

*Primary Examiner*—Sherman D. Basinger
*Assistant Examiner*—Thomas J. Brahan
*Attorney, Agent, or Firm*—Pearne, Gordon, McCoy & Granger

[57] ABSTRACT

An exhaust muffler for mounting on the transom of an inboard or inboard/outboard motorboat around the exhaust pipes which extend from the transom. The muffler comprises a housing which has a pair of sidewalls each adjacent to one of the sides of the boat, so that the housing is approximately equal in width with the width of the boat at the stern. Inside the housing is a baffle extending downwardly from the top of the housing which directs the exhaust downwardly around the bottom of the baffle to reduce the noise emanating from the exhaust. The top of the housing preferably forms a swim platform which provides a functional and attractive appearance to a muffler located outboard of the boat. The large size of the muffler results in enhanced noise reduction without adversely affecting engine performance.

8 Claims, 7 Drawing Sheets

MARINE ENGINE EXHAUST MUFFLER

RELATED APPLICATION

This application is a continuation-in-part of application Ser. No. 887,343, filed July 21, 1986, now U.S. Pat. No. 4,744,778.

BACKGROUND OF THE INVENTION

1. Field of the Invention

This invention relates to an exhaust muffler for use on marine engines of the type found on inboard and inboard/outboard motorboats, and specifically to an outboard exhaust muffler which is located outside the hull of the motorboat at the stern of the boat.

2. Description of the Prior Art

Inboard and inboard/outboard motorboats typically have a plurality of exhaust pipes extending through the transom at the stern of the boat. These exhaust pipes are typically located slightly above the water line. With larger size marine engines, the exhaust noise emanating from the exhaust pipes can be substantial. Such exhaust noise is often disturbing to occupants of the motorboat, to water skiers who are following the boat, to other boaters, and to nearby residents. Many communities have begun to pass noise ordinances which prohibit motorboats producing excess levels of exhaust noise from traveling waterways within those communities. Thus, it is desirable to provide a muffler at the stern of the motorboat to reduce the noise of engine exhaust.

Examples of mufflers located at the stern of inboard motorboats can be found in the following: U.S. Pat. No. 3,187,836, issued to Parker on June 8, 1965; U.S. Pat. No. 3,291,252, issued to Davis on Dec. 13, 1966; U.S. Pat. No. 4,002,136, issued to Michalak on Jan. 11, 1977; and U.S. Pat. No. 4,310,067, issued to Thomson on Jan. 12, 1982.

Such devices provide limited exhaust muffling capabilities due to their limited size and design. Some of these devices must be located inboard, which limits the size that the muffler can have, and thus limits the exhaust muffling capabilities. Some of the devices may be located outboard, but the sizes of such mufflers are still limited for aesthetic reasons. Some mufflers have moving parts that require maintenance and frequently "blow" open, eliminating their muffling capabilities. Generally, the outboard mufflers do not add to the appearance of the motorboat and, in fact, often detract from the appearance of the boat and provide no other suitable functional capabilities to the boat.

SUMMARY OF THE INVENTION

The present invention provides an exhaust muffler for an inboard or inboard/outboard motorboat which provides added capabilities beyond those provided in exhaust mufflers of the prior art. The exhaust muffler of the present invention provides a large muffling chamber located outboard at the stern of the motorboat which provides enhanced muffling capabilities not achieved with the exhaust mufflers of the prior art. The exhaust muffler of the present invention also provides a swimming and diving platform located at the stern of the motorboat. The platform projects rearwardly from the motorboat slightly above the water level and facilitates entering and exiting the motorboat from the water when the engines are shut off. Water skiers may use the platform as a staging area prior to entering the water for skiing with the engine shut off.

Thus, the exhaust muffler of the present invention provides muffling capabilities superior to those provided by the exhaust mufflers of the prior art due to its outboard location and increased size, and it provides a desirable and attractive swimming and diving platform extending aft from the motorboat. Thus, the present invention provides the dual capabilities of quieter exhaust and ease of entering and exiting the motorboat while it is in the water and the engines are shut off.

The large size of the muffler of the present invention helps to avoid the increase in back pressure which can have an adverse effect on engine performance. This is particularly important in performance motorboats in which back pressure and the resulting decrease in engine performance are particularly annoying.

The muffler of the present invention provides adequate noise reduction through all ranges of engine power, from idle through full throttle.

Because the muffler is of a static design, it is not possible to blow the muffler open and eliminate the noise reduction capabilities, as is possible with the movable or variable muffler designs of the prior art. Furthermore, because there are no moving parts in the muffler of the present invention, the muffler is maintenance-free, and it is not necessary to maintain or oil any of the moving parts.

By placing the muffler outboard, there is more usable space within the boat for other features.

These and other capabilities are provided by the present invention of an exhaust muffler for a motorboat having an exhaust pipe extending through the transom at the stern. The muffler comprises a housing located at the stern of the motorboat over the exhaust pipe. The housing comprises a pair of sidewalls each adjacent to one of the sides of the boat and extending aft of the transom. The housing also comprises a top extending between the two sidewalls below the top of the transom and above the exhaust pipe. The top is above the water line and forms a swimming platform. The housing also comprises a bottom extending between the two sidewalls. The housing also comprises a rear wall located aft of the transom and having an exhaust port for the exiting of the exhaust from the exhaust pipes. A baffle is located within the housing for reducing the level of the noise from the exhaust port in the housing.

DETAILED DESCRIPTION OF THE PREFERRED EMBODIMENTS

Figure 1:
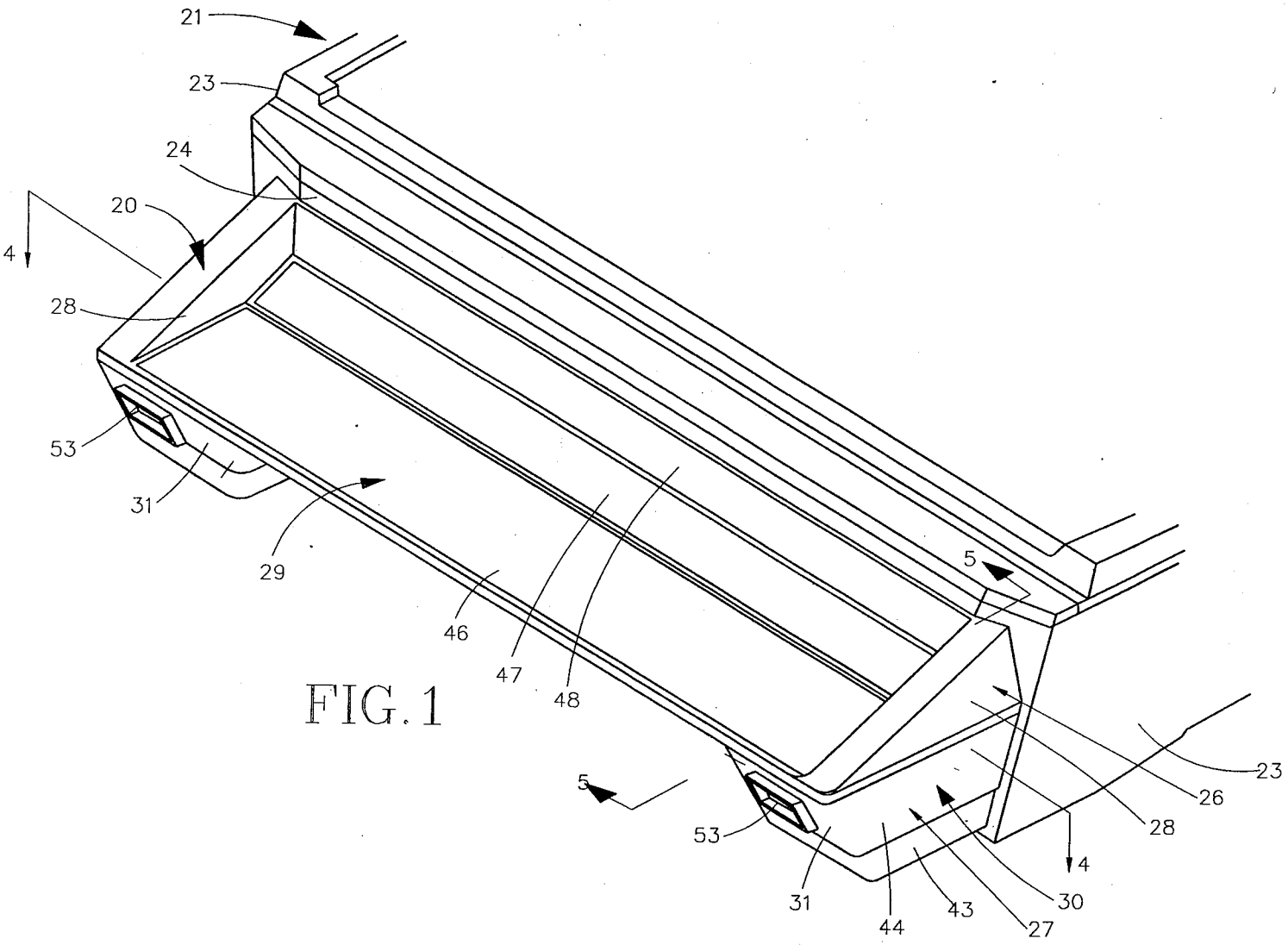
FIG. 1 is a perspective view of the exhaust muffler of the present invention mounted at the stern of a motorboat.

Referring more particularly to the drawings, and initially to FIG. 1, there is shown the muffler 20 of the present invention mounted at the stern of a motorboat 21. The motorboat 21 is a conventional inboard or inboard/outboard motorboat having a marine engine located within the boat and having an exhaust pipe 22 (FIG. 5) extending aft. The stern of the motorboat 21, as shown in FIG. 1, includes a pair of sides 23 and a transom 24. The exhaust pipe 22 extends through the transom 24 of the motorboat slightly above the water line. In the motorboat 21 shown in FIG. 1, there is a single inboard engine with either one or two exhaust pipes 22 located near the center of the transom 24. As will be described later, the muffler of the present invention is capable of modification to accommodate motorboats having dual engines with multiple engine exhausts. In addition, because the muffler of the present invention is symmetrical in design, the muffler can be used with motorboats in which the exhaust pipe extends through either the port or the starboard side of the transom.

Figure 2:
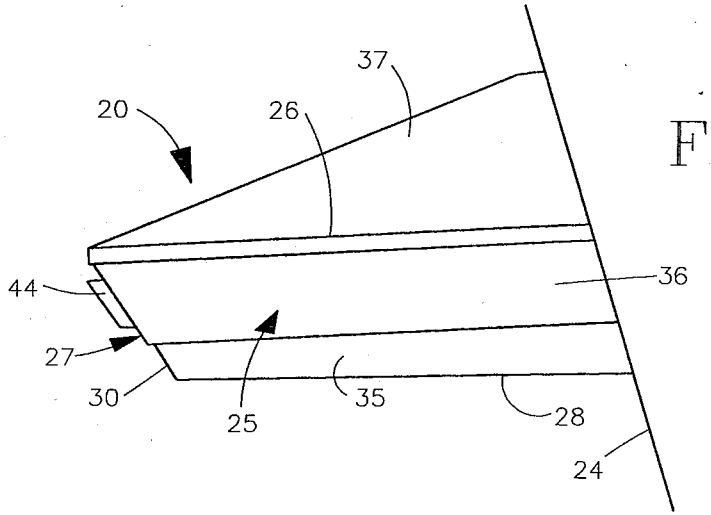
FIG. 2 is a side elevational view of the muffler of FIG. 1.
Figure 3:
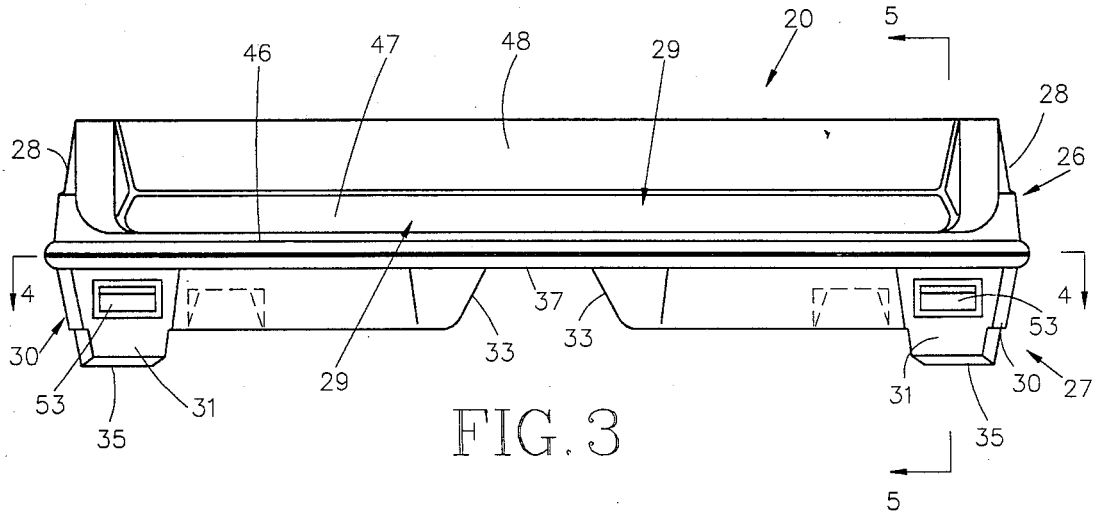
FIG. 3 is a rear elevational view of the muffler of FIG. 1.

The muffler 20 of the present invention mounts on the transom 24 of the motorboat 21, and extends rearwardly from the transom. As shown in FIGS. 1, 2 and 3, the muffler 20 comprises a housing formed by a top portion 26 and a bottom portion 27. The top portion 26 forms the upper half of the muffler 20 and is comprised of a pair of upper exterior sidewalls 28 on each side of a top surface 29. The bottom portion 27 forms the lower half of the muffler 20 and is comprised of a pair of lower exterior sidewall 30, a pair of rear walls 31, one adjacent to each of the lower exterior sidewalls 30, a pair of contoured interior sidewalls 33 each extending from one of the rear walls 31 toward the transom 24 of the motorboat, two lower bottoms 35 extending between each of the interior sidewalls 33 and the exterior sidewalls 30, and a recessed upper bottom 37 extending between the two interior sidewalls 33 directly beneath the top surface 29. The bottom portion 27 also includes a forward wall 38 (FIGS. 4 and 5) adjacent to the transom 24 and having openings 39 through which the exhaust pipes 22 extend.

The top portion 26 and the bottom portion 27 may each be formed of the same material used in the hull of the motorboat 21, such as Fiberglas, or they may be made of aluminum or other suitable laminating material. Preferably, fiber-reinforced plastic, such as Fiberglas, is used, so that the muffler 20 of the present invention is completely non-corrosive and long-lasting. The top portion 26 and the bottom portion 27 are preferably bonded together with epoxy or other suitable material, and they may also be fastened together with pop rivets at the gunwale.

As shown in FIG. 1, the exterior sidewalls 28 and 30 each extend aft from the transom 24, and are generally adjacent to the sides 23 of the motorboat, so that the muffler 20 extends from side to side across substantially the entire stern of the motorboat 21, and the muffler is approximately equal in width to the width of the motorboat at the stern. As shown in FIGS. 1 and 2, each of the lower exterior sidewalls 30 comprises lower sidewall portions 43 and 44 formed in the bottom portion 27 of the muffler 20. The upper sidewalls 28 extend from near the top of the transom 24 to the rearward edge of the top surface 29, and provide support for the top surface 29 as it functions as a swimming platform.

The top surface 29, which extends rearwardly from the transom 24, provides a swimming and diving platform at the stern of the motorboat which may be conveniently used for entering and exiting the boat and as a staging area for water skiing. As with other swimming and diving platforms which are mounted on the sterns of motorboats, the platform formed by the top 29 should be located above the water line but sufficiently close to the water line to function as a platform.

Figure 5:
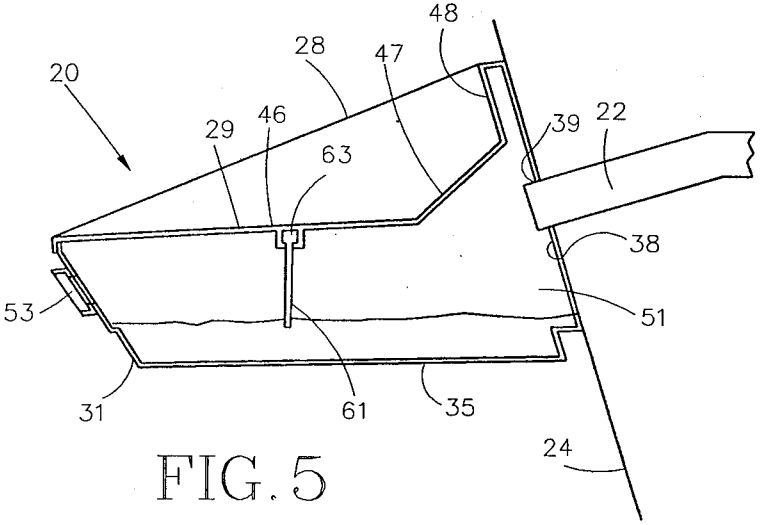
FIG. 5 is a side sectional view taken along line 5—5 of FIGS. 1 and 3.

The top 29 comprises a horizontally extending aft portion 46 and a smaller, sloped forward portion 47 adjacent to the transom 24. As shown in FIG. 5, the sloped portion 47 is provided for clearance for the exhaust pipe 22, which extends through the transom 24 of the motorboat. The top 29 also includes an upwardly extending portion 48 which extends upwardly from the sloped portion 47 adjacent to the transom 24 and terminates at the front, upper portion of the exterior sidewall portion 28, providing a downwardly stepped configuration from the stern.

The recessed upper bottom 37 supports the rearward edge of the top surface 29 along the length between the interior sidewalls 33. The upper bottom 37 extends between the interior sidewalls 33 directly beneath the aft end of the top surface 29.

A pair of hollow muffler chambers 51 are thus formed in each side of the muffler 20. Each of the chambers 51 extends rearwardly from the transom 24 to the rearward edge of the top surface 29. Each chamber 51 is formed by one of the exterior sidewalls 30, one of the rear walls 31, one of the contoured interior sidewalls 33, a portion of the forward wall 38, the lower bottom 35, and a portion of the top surface 29. The forward wall 38 is provided with a pair of openings 39 through which the exhaust from the exhaust pipe 22 enters each of the chambers 51. Each of the chambers 51 extends from the middle of the motorboat toward the outside to permit the flow of exhaust from the exhaust pipe 22 to enter the chamber.

Figure 4:
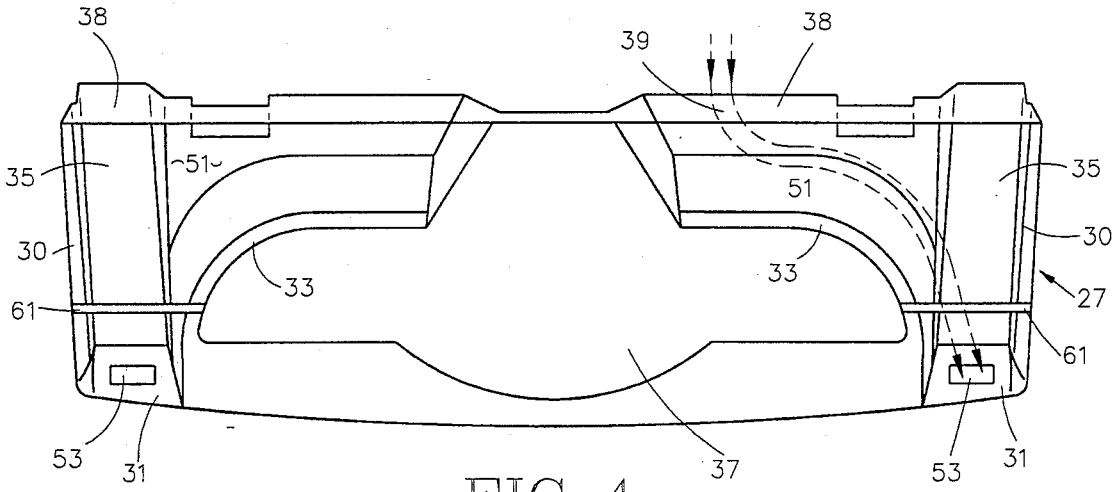
FIG. 4 is a top sectional view taken along line 4—4 of FIGS. 1 and 3.

As shown in FIG. 4, the exhaust is channeled outwardly toward the sides of the muffler 20 by the contoured interior sidewalls 33. The exhaust leaves each of the chambers 51 through ports 53 formed in the rear walls 31. For the muffler 20 shown in FIGS. 1–5, a pair of ports 53 are provided in the rear walls 31, with one port provided on each of the rear walls. The area of each of the exhaust ports 53 must be larger than the cross section of the exhaust pipe 22 in order to prevent excessive back pressure within the chamber 51, which back pressure could have an adverse effect on engine performance. The bottom 35 of the chamber 51 is below the water line, so that water fills the chamber up to the level of the bottom of the exhaust port 53, since the only way in which water can exit through the chamber is through the exhaust port. The exhaust ports 53 should each be approximately just above the water level. If the exhaust ports 53 are located too high, a large amount of water accumulates in the chamber 51, which may create excessive back pressures.

Within each of the exhaust chambers 51, suitable muffler or baffle means are provided. In the embodiment of the invention shown in FIGS. 1–5, baffle means are employed in each of the chambers 51 comprising a downwardly extending baffle 61 mounted from the top surface 29 in the region in which the chamber narrows as the interior sidewall 33 approaches the exterior sidewall 30. Each of the baffles 61 includes a protrusion 53 extending across the top of the baffle which is inserted into a corresponding slot in the bottom of the top surface 29. Alternative muffler means will be described hereinafter.

The bottom 35 and the interior sidewall 33 of each of the chambers 51 are contoured in such a manner as to direct the flow of exhaust water from the exhaust pipe 22 around toward the outside of the chamber and through the exhaust port 53. Each of the baffles 61 extends downwardly from the top surface 29 to require the exhaust flow to turn downwardly below the water line and then back upwardly to the exhaust port 53. If the baffle 61 does not extend a sufficient distance down from the top surface 29, the exhaust flow can flow through the chamber 51 without any baffling effect whatsoever. However, the baffle 61 should not extend down within the chamber 51 to a point in which the area beneath the baffle is such that excessive back pressure may be induced within the chamber.

Since the bottom 35 of the chamber 51 is beneath the water line, water normally fills the chamber as previously noted. As shown in FIG. 5, the baffle 61 may extend downwardly beneath the water line. The exhaust from the exhaust pipe 22 usually includes water, and the water/exhaust mixture is sent through the chamber 51 and must pass beneath the baffle 61 before exiting through the port 53. This convoluted path of the water with the exhaust gas produces optimum muffling effect.

Figure 8:
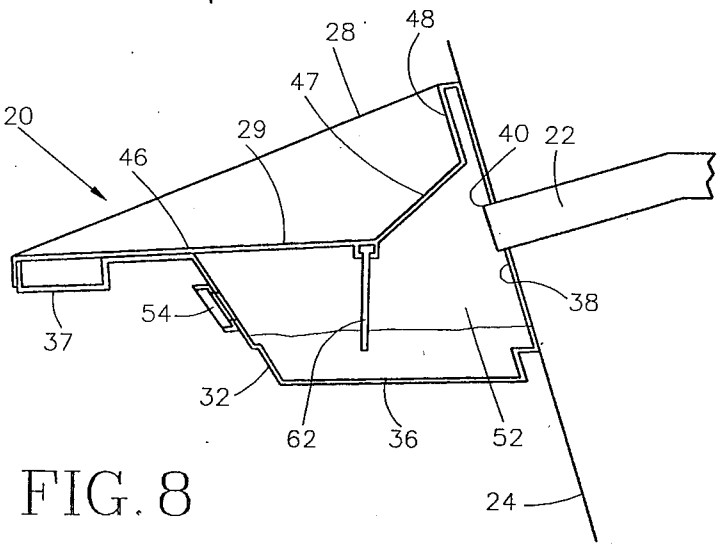
FIG. 8 is a side sectional view similar to FIG. 5, taken along line 8—8 of FIG. 6.
Figure 7:
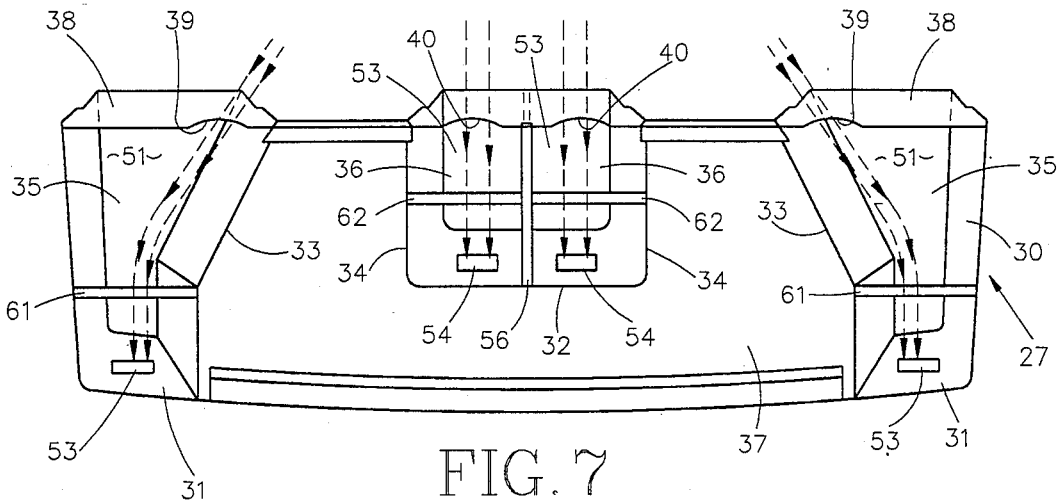
FIG. 7 is a top sectional view similar to FIG. 4 taken along line 7—7 of FIG. 6.
Figure 6:
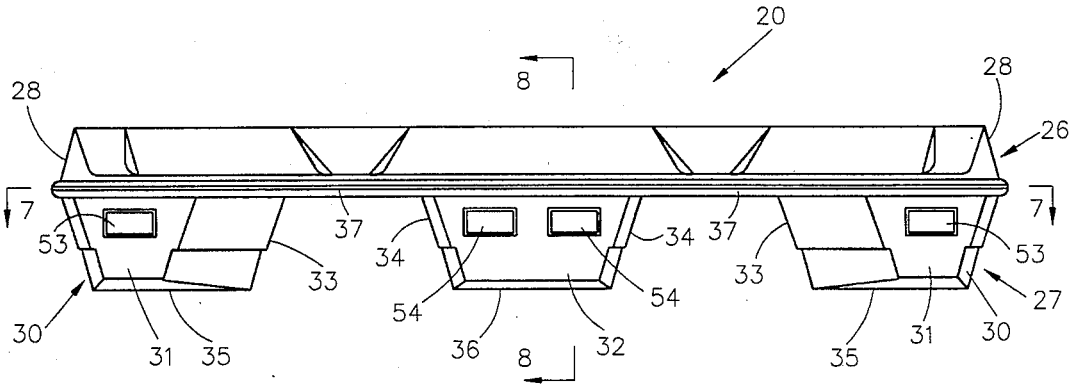
FIG. 6 is a rear elevational view similar to FIG. 3 of an alternative muffler design for motorboats having dual engines.

An alternative muffler design for motorboats having dual engines and multiple exhausts is disclosed in FIGS. 6–8. In this design, two inner muffler chambers 52 are provided in addition to the two outer chambers 51. The two inner chambers 52 are located between the two outer chambers 51 and extend rearwardly from the transom 24. The inner chambers 52 do not extend to the rearward edge of the top surface 29 as the outer chambers 51 do, so that clearance is provided for the engine propellers. The two inner chambers 52 are formed by a recessed rear wall 32, a pair of interior sidewalls 34, the forward wall 38, and a lower bottom 36. The interior sidewalls 34 are located between the interior sidewalls 33. The two inner chambers 52 are separated from each other by a divider 56. The forward wall 38 is provided with additional openings 40 through which two additional exhaust pipes 22 may extend. Two additional ports 54 are provided in the rear wall 32. Exhaust enters the inner chambers 52 through the additional openings 40 in the forward wall 38 and leaves through the ports 54.

As with the outer exhaust chambers 51 already described, similar suitable muffler or baffle means may be provided in the inner chamber. In the embodiment of the invention shown in FIGS. 6–8, a downwardly extending baffle 62 is mounted from the top surface 29 adjacent to the exhaust pipe 22 to direct the exhaust downwardly. The considerations in the placement and dimensions of the baffle 62 are similar to those of the baffles 61 already described.

Other alternative muffler means are shown in FIGS. 9–20.

Figure 10:
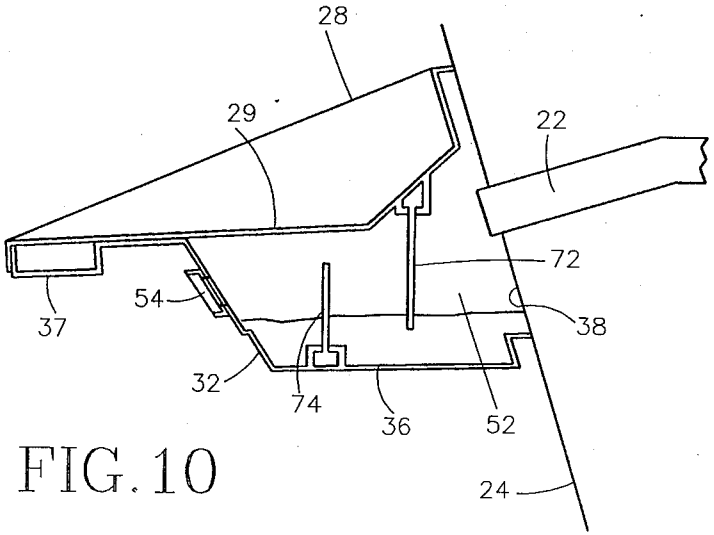
FIG. 10 is a side sectional view similar to FIG. 8, showing the alternative muffler design of FIG. 9.
Figure 9:
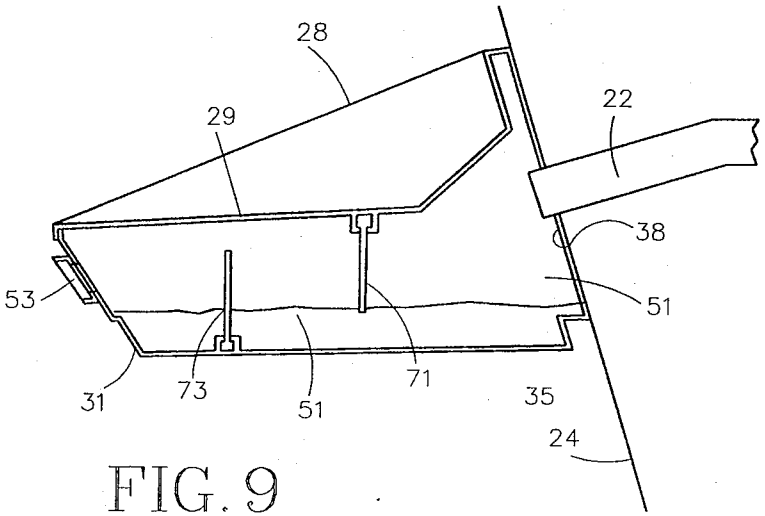
FIG. 9 is a side sectional view similar to FIG. 5, showing an alternative muffler design.

In the first alternative embodiment shown in FIGS. 9 and 10, downwardly extending baffles 71 and 72 are mounted from the top portion 26 adjacent to the outer end of the exhaust pipes 22 to direct the exhaust downwardly, and upwardly extending baffles 73 and 74 are mounted from the bottom portion 27 rearwardly of the baffles 71 and 72 to reverse the flow of the exhaust.

Figure 12:
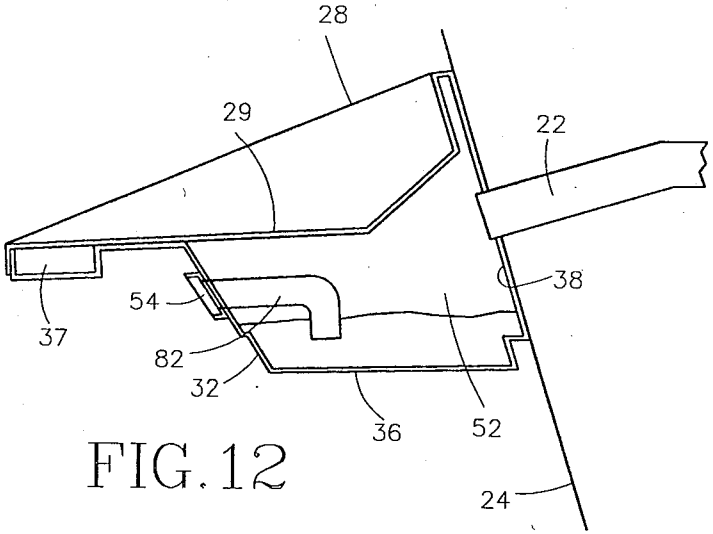
FIG. 12 is a side sectional view similar to FIG. 8, showing the second alternative muffler design of FIG. 11.
Figure 11:
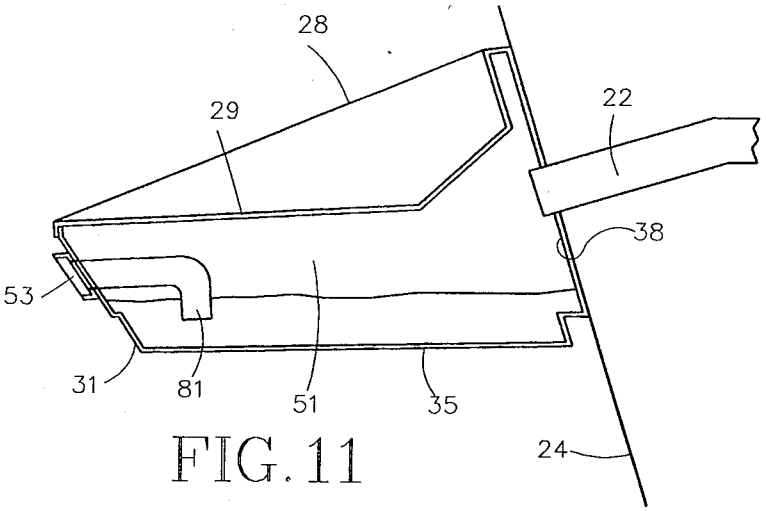
FIG. 11 is a side sectional view similar to FIG. 5, showing a second alternative muffler design.

In the second alternative embodiment shown in FIGS. 11 and 12, downwardly projecting muffler pipes 81 and 82 extend from each of the exhaust ports 53 and 54. The pipes 81 and 82 each have a downwardly directed elbow so that the exhaust from the exhaust pipe 22 is mixed with water already in the chamber 51, which then enters through the bottom of the pipes 81 and 82 and exits through the ports 53 and 54 when the water level in the chamber becomes higher than the level of the port.

Figure 14:
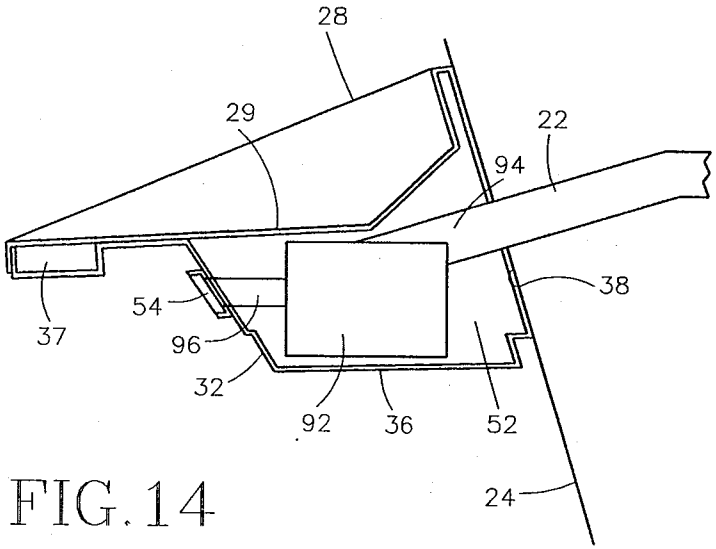
FIG. 14 is a side sectional view similar to FIG. 8, showing the third alternative muffler design of FIG. 13.
Figure 13:
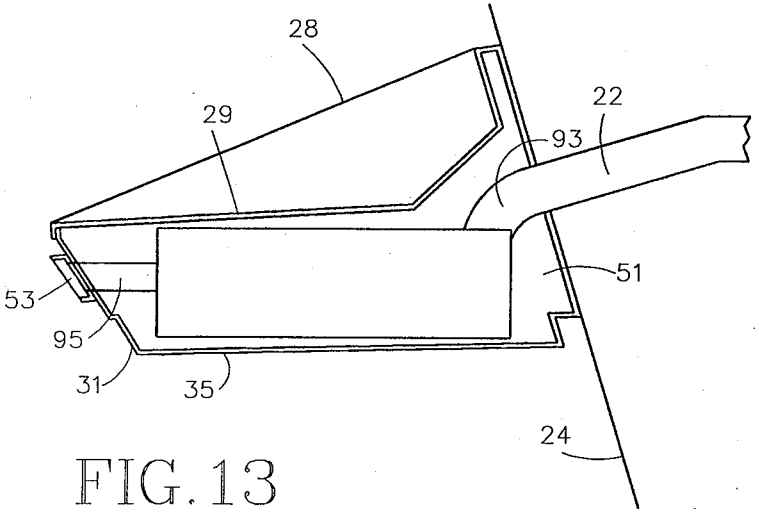
FIG. 13 is a side sectional view similar to FIG. 5, showing a third alternative muffler design.

In the third alternative embodiment shown in FIGS. 13 and 14, conventional muffler chambers 91 and 92 are employed within the chambers 51 and 52. Each muffler chamber has an entry pipe 93 or 94 connected directly to the outer end of one of the exhaust pipes 22, and has an exit pipe 95 or 96 connected to one of the ports 53 and 54.

Figure 16:
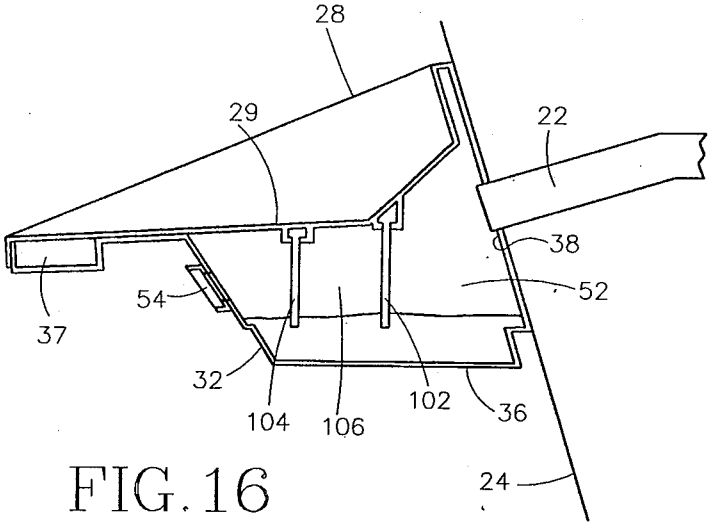
FIG. 16 is a side sectional view similar to FIG. 8 showing the fourth alternative muffler design of FIG. 15.
Figure 15:
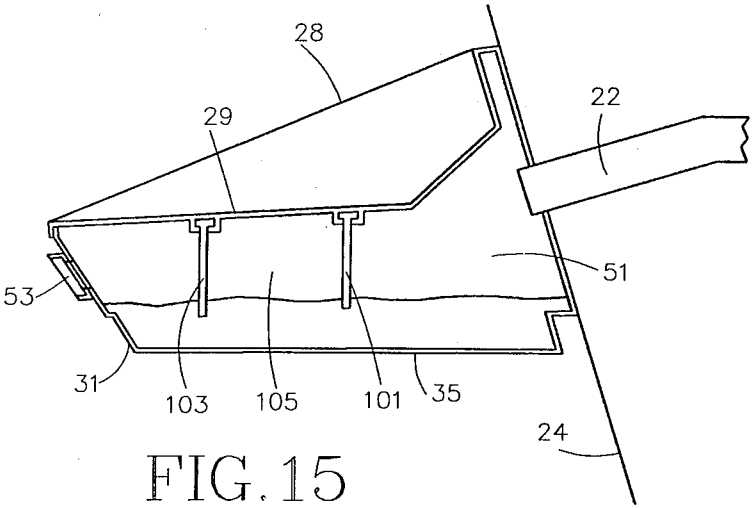
FIG. 15 is a side sectional view similar to FIG. 5, showing a fourth alternative muffler design.

In the fourth alternative embodiment shown in FIGS. 15 and 16, pairs of downwardly extending baffles 101–104 are mounted from the top portion 26. The exhaust from the exhaust pipes 22 strikes the first baffles 101 and 102 and is directed into the intermediate space 105 or 106 between the first baffles 101 and 102 and the second baffles 103 and 104. The exhaust then travels downwardly around the second baffles 103 and 104 before exiting through the ports 53 and 54.

Figure 18:
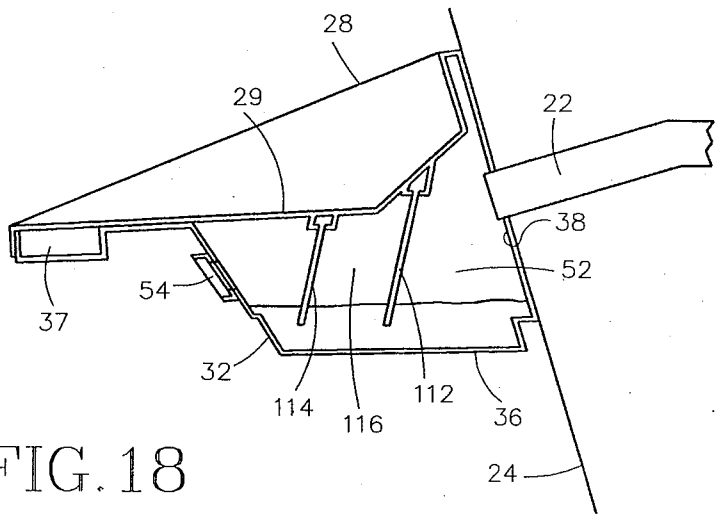
FIG. 18 is a side sectional view similar to FIG. 8, showing the fifth alternative muffler design of FIG. 17.
Figure 17:
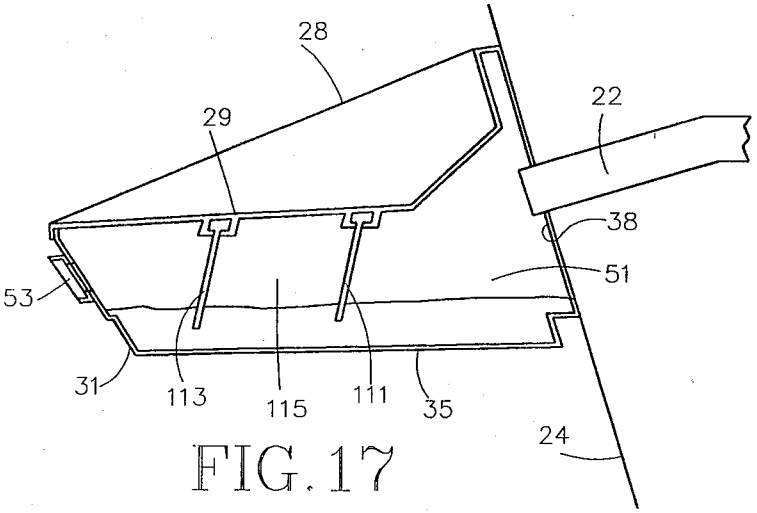
FIG. 17 is a side sectional view similar to FIG. 5, showing a fifth alternative muffler design.

A fifth alternative muffler design is shown in FIGS. 17 and 18. This muffler design employs pairs of downwardly extending baffles comprising first baffles 111 and 112, and second baffles 113 and 114. In comparison to the baffles 101–104 shown in FIGS. 15 and 16, the baffles 111–114 are sloped rearwardly and thus produce a different flow through the chambers 51 and 52, and may result in different pressures within the chambers.

Figure 20:
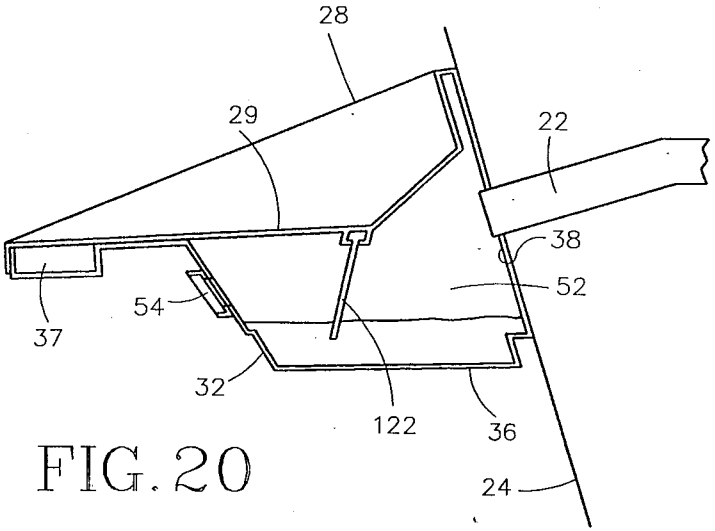
FIG. 20 is a side sectional view similar to FIG. 8, showing the sixth alternative muffler design of FIG. 19.
Figure 19:
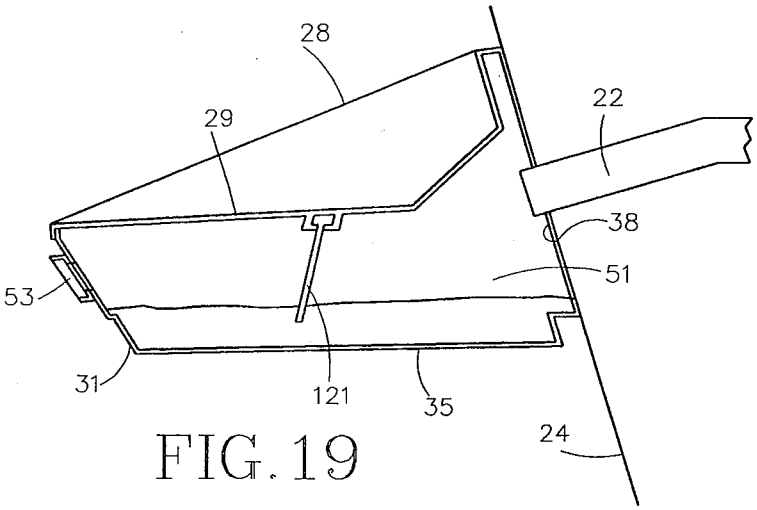
FIG. 19 is a side sectional view similar to FIG. 5, showing a sixth alternative muffler design.

A sixth alternative muffler design is shown in FIGS. 19 and 20. This muffler design comprises single downwardly extending baffles 121 and 122. Unlike downwardly extending baffles 61 and 62, shown in FIGS. 5 and 8, the baffles 121 and 122 are sloped rearwardly, thus producing an exhaust flow having different characteristics.

The particular design of the muffler means used within the chambers 51 and 52 depends upon the exhaust pressures provided through the exhaust pipe 22, the desired reduction in noise level, the back pressures experienced within the chambers, and other factors which are known in the art. It is contemplated that one of the alternative muffler designs herein shown, or other suitable design, may be substituted for the designs shown in the preferred embodiments of FIGS. 1–8 to produce a suitable muffler which has the desired reduction in noise level without producing excessive back pressures or other effects which may adversely affect the performance of the marine engine.

By combining the muffler of the present invention with a swimming platform, it is possible to make a much larger muffler chamber and still maintain the aesthetic appearance of the boat. Thus, with a larger muffler chamber than is typical in the prior art, it is possible to have a muffler which results in a larger amount of noise reduction than with the mufflers of the prior art.

Since the exhaust of marine engines typically includes cooling water, the design of the muffler should be such that it accommodates the flow of cooling water mixed with exhaust gases which would pass through the muffler. Thus, it is important that the exhaust ports 53 and 54 provided in the rear wall of the muffler be positioned to permit the flow of water out of the muffler and to avoid the accumulation of excessive amounts of water in the muffler chamber.

While a preferred design of the muffler of the present invention is mounted on the transom of an inboard or inboard/outboard motorboat, alternative designs are possible. For example, the muffler of the present invention may be integrally formed with the motorboat rather than attached to the exterior of the boat. Thus, the rear of the motorboat may include a housing integrally formed with the boat providing a top which is below the normal rear transom of the boat, forming a swimming platform, with one or more chambers being formed beneath this top, each chamber having a muffler means within to provide the advantages of the present invention.

Other modifications are also possible. For example, a muffler may be designed with a single large chamber for use on a motorboat having only a single exhaust pipe, in which case, the rear wall would be provided with a single exhaust port.

The muffler of the present invention may also be employed with outboard engines in which the engine exhaust is provided through an exhaust pipe at the stern of the motorboat. With the exhaust pipe provided at the stern of the boat, the muffler of the present invention may be mounted on the transom to provide the benefits of this invention.

The present invention also provides a swim platform which has many advantages over prior art swim platforms. In contrast to the prior art swim platform made of wood, the platform of the present invention is formed of fiber-reinforced plastic, such as Fiberglas, and thus is less likely to deteriorate as wood would, and is less vulnerable to damage during docking and through other use of the boat. Furthermore, the swim platform provides natural protection to the swimmers from the outboard drive which is normally located beneath the swim platform.

While the invention has been shown and described with respect to particular embodiments thereof, this is for the purpose of illustration rather than limitation, and other variations and modifications of the specific embodiments herein shown and described will be apparent to those skilled in the art, all within the intended spirit and scope of the invention. Accordingly, the patent is not to be limited in scope and effect to the specific embodiments herein shown and described, nor in any other way that is inconsistent with the extent to which the progress in the art has been advanced by this invention.

What is claimed is:

1. An outboard exhaust muffler for a motorboat having an exhaust pipe through which exhaust is emitted through the transom above the water line at the stern, which comprises:

an enclosed housing extending across the stern of the boat over the exhaust pipe into which the exhaust is emitted, the housing being attached to the transom and extending aft of the transom and aft of the boat, the space within the enclosed housing defining muffler means for reducing the noise of the exhaust, the housing comprising:

a pair of sidewalls each adjacent to one of the sides of the boat extending aft of the transom;

a top extending between the two sidewalls above the exhaust pipe;

a bottom extending between the two sidewalls below the exhaust pipe;

a rear wall extending from the top to the bottom between the two sidewalls, the rear wall having an exhaust port through which the exhaust leaves the enclosed housing; and a baffle extending vertically downwardly from the top to the water line within the enclosed housing, the exhaust from the exhaust pipe being directed downwardly beneath the bottom of the baffle and out the exhaust port.

2. An exhaust muffler as defined in claim 1, wherein the sidewalls of the housing include an upper sidewall portion extending above the top of the housing and sloping upwardly toward the top of the transom.

3. An exhaust muffler as defined in claim 1, wherein the bottom includes a recessed portion which is higher than the other portion of the bottom.

4. An exhaust muffler as defined in claim 3, wherein the recessed portion of the bottom is located in the central portion of the housing.

5. An exhaust muffler as defined in claim 1, comprising in addition at least one second baffle extending upwardly from the bottom of the housing.

6. An exhaust muffler as defined in claim 1, comprising in addition at least one baffle extending upwardly from the bottom of the housing in a rearwardly sloped direction.

7. An exhaust muffler as defined in claim 1 for a motorboat having a plurality of exhaust pipes, wherein there are a plurality of exhaust ports in the rear wall.

8. An exhaust muffler as defined in claim 7, wherein the housing forms a plurality of separately enclosed muffling chambers, with one of the exhaust ports associated with each of the chambers.

* * * * *